United States Patent [19]

Obrist

[11] Patent Number: 4,469,252

[45] Date of Patent: Sep. 4, 1984

[54] TWO-COMPARTMENT PACKAGE

[75] Inventor: Gerhard Obrist, Kaiseraugst, Switzerland

[73] Assignee: Aerosol Service AG, Möhlin, Switzerland

[21] Appl. No.: 361,418

[22] Filed: Mar. 24, 1982

[30] Foreign Application Priority Data

Apr. 10, 1981 [CH] Switzerland ..... 2400/81

[51] Int. Cl.[3] ..... B65D 83/14

[52] U.S. Cl. ..... 222/135; 222/399; 222/402.14

[58] Field of Search ..... 222/105, 129, 135, 136, 222/137, 399, 402.14, 402.1, 190; 169/85, 88; 239/304, 307, 308; 215/DIG. 8; 206/221

[56] References Cited

U.S. PATENT DOCUMENTS

| | | | |
|---|---|---|---|
| 3,080,094 | 3/1963 | Modderno . | |
| 3,225,967 | 12/1965 | Heimgartner | 222/105 |
| 3,718,235 | 2/1973 | Cronan . | |
| 3,773,264 | 11/1973 | Cronan . | |
| 3,804,302 | 4/1974 | Yamada et al. | 222/402.14 |

FOREIGN PATENT DOCUMENTS

| | | | |
|---|---|---|---|
| 649749 | 7/1964 | Belgium | 169/85 |
| 1801518 | 1/1971 | Fed. Rep. of Germany . | |
| 1929844 | 2/1973 | Fed. Rep. of Germany . | |
| 1040155 | 10/1953 | France | 169/88 |
| 1146968 | 11/1957 | France | 169/88 |
| 81145 | 6/1963 | France | 222/399 |
| 1357983 | 3/1964 | France . | |
| 1431181 | 1/1966 | France . | |
| 2015337 | 4/1970 | France . | |
| 696702 | 9/1953 | United Kingdom | 169/85 |

*Primary Examiner*—H. Grant Skaggs

*Attorney, Agent, or Firm*—Werner W. Kleeman

[57] ABSTRACT

The package comprises a commercially available outer standard aerosol container equipped with a standard dispensing valve and a likewise commercially available inner standard aerosol container equipped with a standard dispensing valve. The inner container is arranged substantially coaxially with respect to the outer container, and such inner container is at a greater pressure than the outer container. Both of the dispensing valves of both containers are kinematically coupled in a manner such that upon normal actuation of the outer dispensing valve there is opened the inner dispensing valve. There are provided, for instance, latching cams or the like which retain the inner dispensing valve in its open position. After actuating the outer valve and thus also the inner valve the contents of the inner container empty into the outer container and admix with its contents. The mixture then can be removed in conventional fashion by means of the outer dispensing valve. Apart from the functional reliability and simplicity in handling of the two-compartment package such also exhibits an extremely simple construction, which particularly is realized by virtue of the fact that the package can be fabricated by extensively using standard components.

17 Claims, 9 Drawing Figures

TWO-COMPARTMENT PACKAGE

CROSS-REFERENCE TO RELATED APPLICATION

This application is related to my commonly assigned, copending U.S. application Ser. No. 177,640, filed Aug. 13, 1980, and entitled "Two-Compartment Pack" U.S. Pat. No. 4,340,155, granted July 20, 1982.

BACKGROUND OF THE INVENTION

The present invention relates to a new and improved construction of a two-compartment package or pack.

Generally speaking, the two-compartment package or pack of the present development is of the type containing an essentially dimensionally or form stable outer container for a first packaged material or component and equipped with a dispensing valve. An inner container for a second packaging material or component is arranged within the outer container. Externally actuatable or releasable means serve for emptying the filled contents of the inner container into the outer container and for conjointly dispensing both of the packaged materials or components.

Two-component packages or packs of this type are used whenever different types of packaged or filled materials must be separately stored and should only commingle with one another immediately prior to their use. As an example reference is made simply, by way of illustration and not limitation, to hair dyes and the like.

Essential requirements which are placed upon such two-compartment packages are, on the one hand, that they must possess extreme simplicity in their construction and, therefore, have low fabrication costs and, on the other hand, they must be capable of being simply and reliably handled or used, and at the same time there should be ensured for good admixing of the individual packaged materials or components.

For many fields of applications, particularly for instance also in the case of hair dyes, it is desirable or required that the packaged or filled materials can be dispensed in an aerosol or foam consistency. For these fields of application there only can be used an aerosol two-component package, i.e. a spray can.

The only heretofore known aerosol two-compartment pack or package usable as a practical matter for such purpose, as far as applicant is aware, has been disclosed in the afore- mentioned commonly assigned, copending U.S. application Ser. No. 177,640, filed Aug. 13, 1980. Such two-compartment pack comprises an outer container and an inner container, each serving to store a component of the packaged material, and a pressurized gas. Both of the containers are at the same internal pressure. The inner container is closed by means of a displaceable piston. By venting a portion of the pressurized gas from the outer container the piston within the inner container is displaced because of the then prevailing unequal pressure conditions, and thus releases flow communication openings leading to the outer container, so that the package components can admix.

Although this known two-component package or pack is capable of extensively satisfying the previously mentioned requirements, it has however been found that it can still be further improved upon, particularly as concerns its construction, and therefore, also with respect to the economies of fabrication thereof.

A further state-of-the-art aerosol two-component package is disclosed in U.S. Pat. No. 3,718,235. With this package or pack an inner container is located in an outer container which contains the one package component and a propellant gas. The inner container is closed by a mountable cover. Retained in the inner container is a spiral spring under stress, this spring, when released, detaching the cover from the container. The spring is held in a stressed or tensioned condition by two legs of a resilient clamp, these legs being spread apart by a metallic ball. By shaking or jarring the entire package it is possible to propel the ball out of the clamp by the action of inertia, so that its legs release the spiral spring and such finally opens the cover of the container.

The two-compartment package or pack of this U.S. Pat. No. 3,718,235 does not possess adequate safeguards that the inner container will not unintentionally open, and hence, both of the package components prematurely admix with one another. Additionally, this package is relatively cumbersome to handle and the admixing of the package components is not accomplished automatically, rather there are required specific manipulations of the package, such as shaking the same and the like.

In the published French Patent application No. 2,015,337 there is furthermore known to the art an aerosol two-component package containing within a stable outer container two interfitted flexible inner containers. Each of the package components is located in a respective one of these inner containers and the propellant gas is located between the larger inner container and the outer container.

At the cover of the package, constructed as a conventional aerosol container or spray can, there is imbedded a standard aerosol valve. Coaxially secured to this valve is a second valve by means of an adaptor. This second valve closes the innermost container. Both valves are interconnected by means of a thrust rod in such a manner that, upon opening of the outer valve, following a slight time-delay, there is also opened the inner valve. If the outer valve is again released there is also again closed the inner valve. Both of the valves and their connection adaptor are constructed such that both package components, upon opening the valves, are admixed in the adaptor and are conjointly dispensed through the outer valve. In each case only the dispensed quantities of the package components are admixed, the residual quantities remaining in the package remain unmixed in their related container. However, with this two-component package there is not accomplished any emptying of the one container into the other container, and thus, admixing of the total contents of both containers.

A different construction of two-component package is also known from German Patent Publication No. 1,801,518. With this package one of the filled or packaged components is located in a glass ampoule arranged in a spray can. The glass ampoule can be shattered by means of a plunger coupled with a dispensing valve. This two-component package has not found practical applications for a number of different reasons.

Furthermore, in French Pat. No. 1,431,181 there is disclosed a two-component package which consists of two separate aerosol containers, each of which contains one of the packaged components together with a propellant gas. Both of the containers have their shape coordinated to one another and, for instance, can be interconnected by being threaded together. At the confronting surfaces they are equipped with a respective valve which automatically open when both of the containers are intercoupled. Consequently, the contents of the container which is under greater pressure empties into the other container and at that location both of the packaged or filled components admix. This other container is equipped with a conventional dispensing valve, by means of which there can be then dispensed both of the packaged or filled components in the admixed form. The drawback of such two-component package resides in the fact that, it is rather complicated in its construction and also relatively cumbersome to handle.

German Pat. No. 1,929,844 discloses a two-component package which is extensively similar to the package construction discussed above with respect to the French Patent application No. 2,015,337. Also with this package there does not occur any admixing of the total quantities or contents of both filled or packaged components, rather in each case only the dispensed package quantities are admixed with one another directly prior to dispensing.

In U.S. Pat. No. 3,080,094 there is described a two-component package, wherein both of the packaged components are separated by a membrane within the aerosol container. This membrane can be punctured by a puncturing element connected with the dispensing valve, whereby both of the components then can admix. Also this package is associated with certain drawbacks, and therefore, has not been accepted in practice.

Finally, in U.S. Pat. No. 3,773,264 there is disclosed a further construction of two-component package or pack wherein, just as was the case for the package of the previously discussed U.S. Pat. No. 3,718,235, a filled or package component is located in a separate container in the spray can. This container possesses a spring-loaded cover member which can be opened by a trigger mechanism. This trigger mechanism is actuated by a ball, which by appropriate shaking movements of the spray can can be caused to impact against the trigger mechanism. This prior art package, while equipped with safety means which safeguards against unintentional opening of the inner container, still is rather complicated in its construction and also cumbersome to handle.

SUMMARY OF THE INVENTION

Therefore, with the foregoing in mind it is a primary object of the present invention to provide a new and improved construction of a two-compartment package or pack which is not associated with the aforementioned drawbacks and limitations of the prior art constructions.

Another and more specific object of the present invention aims at providing a new and improved construction of a two-compartment package suitable for reliably dispensing the packaged or filled materials in an aerosol form, and which essentially complies to a considerable degree with the initially discussed requirements placed upon such packages.

Yet another and more specific object of the present invention aims at the provision of a new and improved construction of a two-compartment package which can be constructed by extensively using standard components normally employed in the aerosol technology, and thus, can be fabricated in a most economical fashion.

Still a further significant object of the present invention aims at a new and improved construction of two-compartment pack or package which extensively eliminates the possibility of faulty manipulations and, in the event of faulty manipulations, such can not cause any appreciable deleterious results.

Now in order to implement these and still further objects of the invention, which will become more readily apparent as the description proceeds, the two-compartment package of the present development is generally manifested by the features that, the inner container is constructed as an independent aerosol container equipped with a dispensing valve. This inner container is at a higher internal pressure than the outer container and its dispensing valve communicates with the internal space of the outer container. The dispensing valve of the inner container is kinematically operatively coupled with the dispensing valve of the outer container in such a manner that, upon normal actuation of the dispensing valve of the outer container, there is opened the dispensing valve of the inner container. Additionally, means are provided which fixedly retain the dispensing valve of the inner container in its open position.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
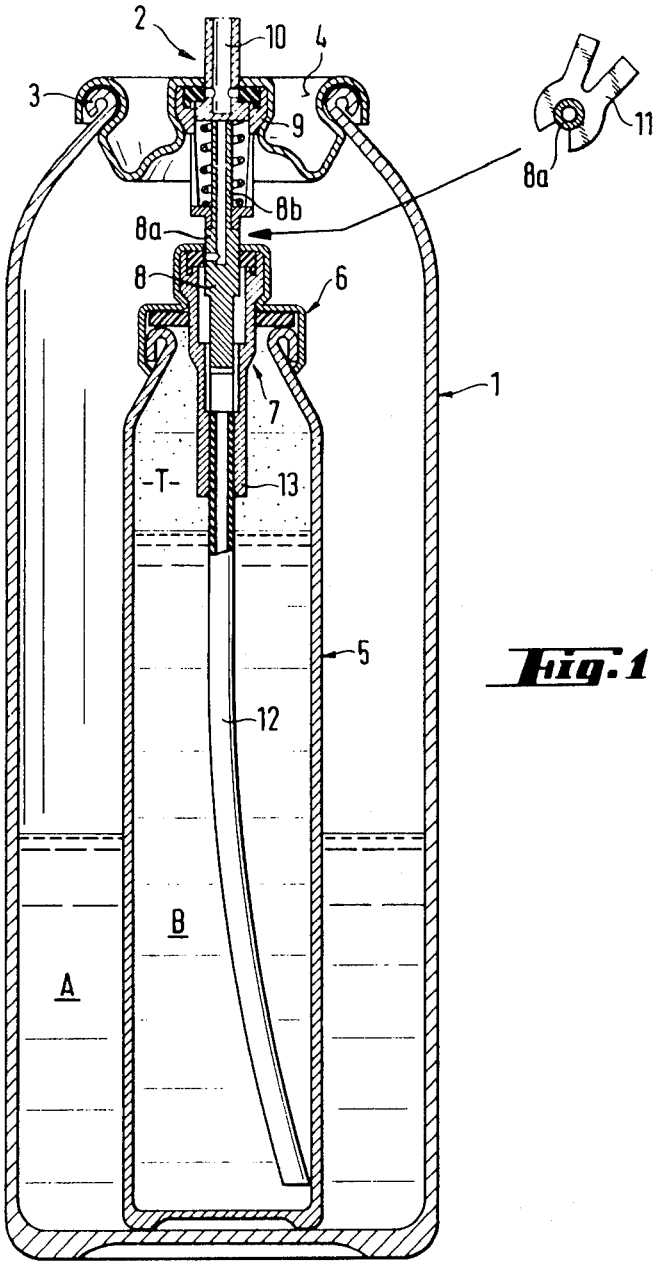
FIG. 1 is a longitudinal and axial sectional view through a first exemplary embodiment of two-compartment package or pack according to the invention showing the same prior to opening of the dispensing valve of the inner container.
Figure 2:
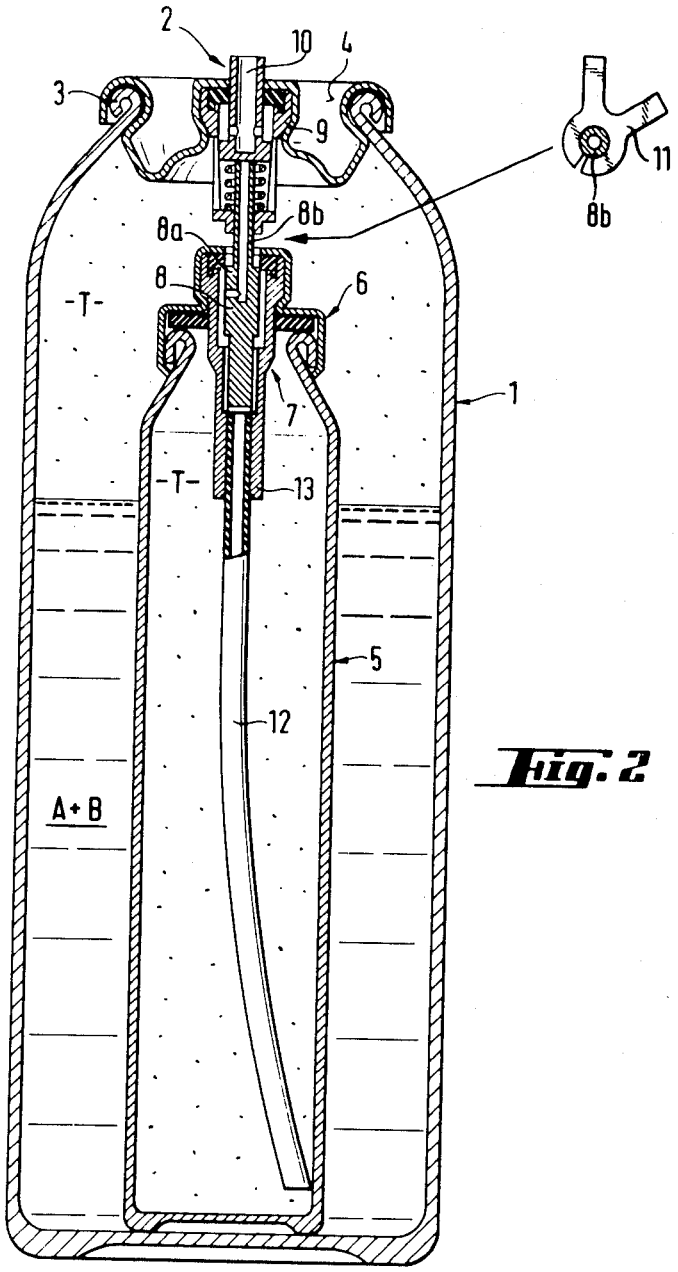
FIG. 2 is a longitudinal and axial sectional view of the package arrangement of FIG. 1, however showing the two-compartment package following opening of the dispensing valve of the inner container.

Describing now the drawings, the two-compartment package or pack, shown by way of example and not limitation in FIGS. 1 and 2, constitutes the simplest constructional embodiment. This two-compartment package will be seen to comprise an outer standard aerosol container 1 equipped with a standard aerosol valve 2 which is fitted in conventional manner in a cover member 4 which is connected in a seal-tight fashion at the upper opening or marginal open edge 3 of the container 1. Additionally, such two- compartment package will be seen to comprise an inner standard aerosol container 5 containing a cover member 6 and a standard aerosol valve 7 fitted in the cover member 6.

The containers 1 and 5, the cover members 4 and 6, and dispensing valves 2 and 7 as well as their assembly are well known in this art, so that at this point no particular explanation thereof is believed to be necessary. It is merely mentioned, however, that standard aerosol valves possess an axially inwardly movable actuation and dispensing tube which can be displaced against the action of the restoring force of a spring or another suitable elastic element for the purpose of opening the valve, and through which the packaged or filled material can then be removed from the related container.

The outer or external container 1 contains the filled or packaged component A, the inner container 5 the filled or packaged component B as well as a suitable propellant T which, generally, is constituted by an easily volatilizable gas, such as Freon or the like. The dimensions of the containers 1 and 5 are dependent upon the volume of the packaged or filled materials which are to be dispensed and their ratio. At most the diameter of the inner container 5 can be almost just as large as the diameter of the opening or marginal open edge 3 of the outer container 1, so that the inner container 5 can be inserted through such opening or marginal open edge 3 of the outer container 1. As far as the conventional sizes are concerned this condition, as a rule, is usually fulfilled with the normal or standard aerosol containers.

The dispensing or egress tube 8 of the valve 7 of the inner container 5 extends through the valve housing 9 of the outer dispensing valve 2 up to the dispensing tube 10 of such outer valve 2, so that both of the actuation and dispensing tubes 8 and 10 are therefore kinematically coupled to one another.

The dispensing tube 8 possesses a lower thickened or enlarged portion or section 8*a* and an upper or forward thinner portion or section 8*b*. In the starting position depicted in FIG. 1, where both of the packaged or filled components A and B are still separated from one another in their related containers 1 and 5, a resilient clamp 11 is seated upon the enlarged or thicker section 8*a* of the dispensing tube 8. In FIGS. 1 and 2 this clamp or clamp member 11 has been shown separately in order to improve the clarity of the illustration.

In order to admix both of the packaged or filled components A and B the dispensing valve 2 of the outer container 1 is briefly opened by inwardly pressing or depressing the dispensing tube 10, as best seen by referring to FIG. 2. Hence, by virtue of the kinematic coupling of both of the dispensing tubes 8 and 10 also the dispensing tube 8 of the inner valve 7 is inwardly pressed and the valve 7 is opened. By virtue of the downward movement of the inner dispensing tube 8 the clamp member 11 engages with the thinner tube section or portion 8*b* and, since it bears at the valve housing 9 of the outer valve 2, fixedly retains the inner valve 7 in its open position, even if the dispensing tube 10 of the outer valve 2 is again released.

Because of the higher internal pressure which prevails in the inner container 5 its contents are very rapidly propelled through a riser or up-tube 12, the housing 13 of the inner valve 7, its dispensing or dispenser tube 8 and the housing 9 of the outer valve 2 into the outer container 1, and at that location intensively admixed with the packaged or filled component A, where there now also is present propellant gas in the otherwise originally pressureless outer container 1.

The removal of the packaged mixture A+B now is accomplished in conventional manner through the outer valve 2, and the container 1 along with the valve 2 is held in a position where it is directed downwardly.

With the above-described embodiment of the inventive two-compartment package the entire propellant gas T required for the emptying of the package is originally located in the inner container 5, whereas the outer container 1 is without pressure. Of course it is possible to also originally provide in the outer container 1 a propellant gas or agent which is pressurized, in which case then the inner container 5 must be retained at a higher pressure, for instance by means of an additional nitrogen cushion or the like.

Additionally, it is basically also possible to construct the inner container 5 and, if desired, also the outer container 1 as a so-called two-chamber package containing a inner sack or bag which can be pressed together or collapsed. In such case the filled or packaged material would be arranged in each instance in such collapsable sack or bag and the propellant gas would be located in the intermediate space between such collapsible bag and the related container. In each instance the inner container, of course, must be at a higher pressure than the outer container.

With the embodiment of FIGS. 1 and 2 the inner container 5 bears at the not particularly referenced floor or base of the outer container 1. In the event that the length of the inner container 5 is not sufficient for this purpose, then there could of course be provided an appropriate pedestal or false bottom or the like.

In FIGS. 3 to 6 there have been illustrated four further exemplary embodiments of the inventive two-compartment packageor pack. As a matter of convenience in illustration here also the same or analogous components have been usually designated by the same reference characters as have been generally used in the above discussion of the embodiment of FIGS. 1 and 2.

Figure 3:
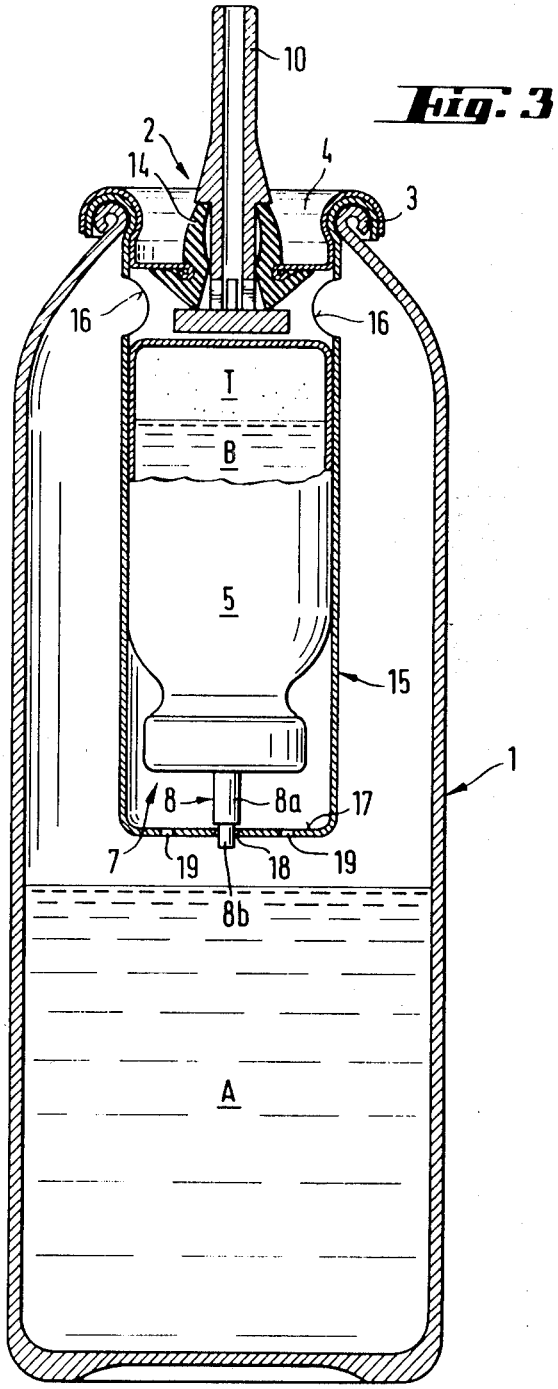
FIGS. 3, 4, 5 and 6 respectively show in axial sectional view four additional exemplary embodiments, in each instance prior to opening of the inner dispensing valve and analoguous to the showing of FIG. 1.

With the embodiment of FIG. 3 the dispensing valve 2 of the outer container 1 is a so-called high-output type valve, wherein the dispensing tube 10 is supported to be tiltable and axially inwardly adjustable within an elastic collar or bracket 14 or equivalent structure. In this case the inner container 5 is arranged to be inverted or upside down in a holder or support sleeve 15 through an angle of 180° with respect to the outer container 1. The sleeve or sleeve member 15 is secured at the opening or marginal open edge 3 of the outer container 1.

The sleeve member 15 is snugly seated at the inner container 5 and fixedly retains such by the action of friction. It is equipped at its upper region with openings or holes 16, through which the contents of the outer container 5 can reach its dispensing valve 2. The dispensing tube 8 of the inner valve 7 bears by means of its enlarged portion or section 8*a* at the floor 17 of the sleeve member 15 and protrudes by means of its thinner portion or section 8*b* through an opening 18 provided at the floor 17. Further openings or holes 19 in the floor 17 prevent the formation of a pressure cushion at the lower portion or region of the sleeve member 15.

With this embodiment and in contrast to the exemplary embodiment of FIGS. 1 and 2, it is not the inner container 5, but rather the dispensing tube 8 of its valve 7 which is stationarily arranged with regard to the outer container 1. Upon actuation of the outer valve 2 the dispensing tube 10 thereof downwardly displaces the inner container 5 and thus opens such valve 7. By virtue of the snug clamping fit of the sleeve member 15 upon the inner container 5, upon release of the outer valve 2, such inner container can no longer return back into its original position and the inner valve 7 therefore remains open.

The dispensing or egress tube 10 of the outer valve 2 does not bear upon the floor of the inner container 5, rather has a slight spacing therefrom. This enables opening the outer valve 2, for instance for the purpose of filling the propellant gas or propellant into the outer container 1, without at the same time having to also open the inner valve 7. The opening ofsuch inner valve 7, with suitable dimensioning of the individual parts or components, is only possible when the dispensing tube 10 of the outer valve 2 is completely inwardly pressed.

Figure 4:
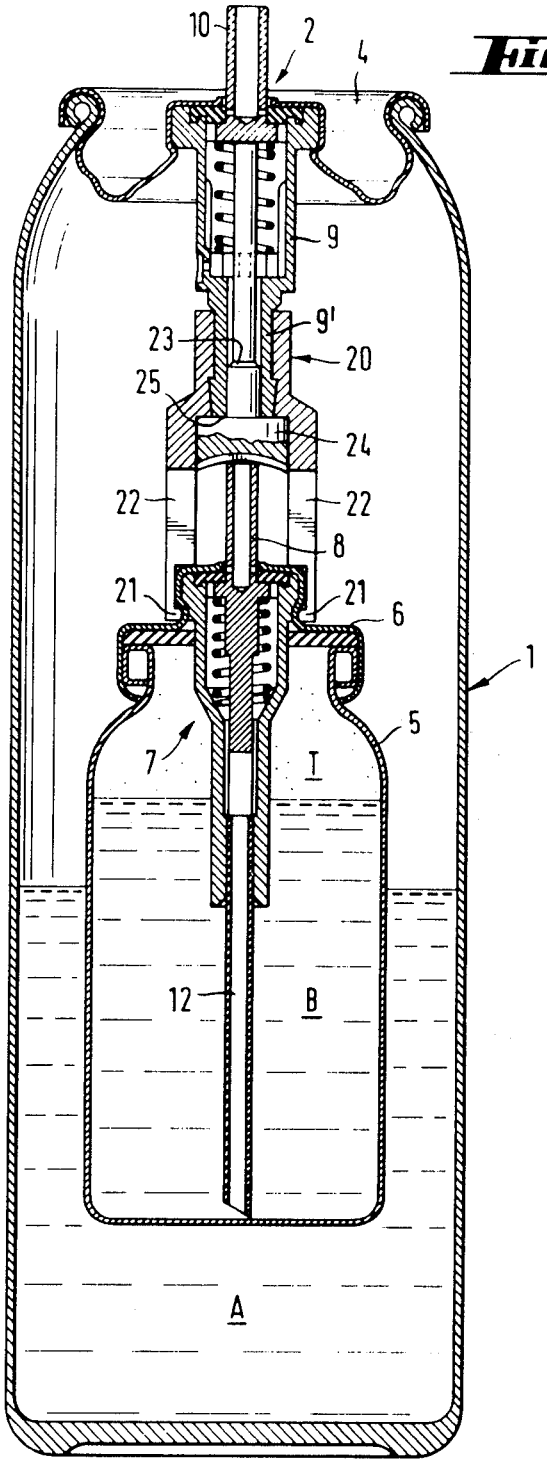

With the exemplary embodiment illustrated in FIG. 4 the inner container 5 is secured by means of an adaptor 20 at the housing 9 of the dispensing valve 2 of the outer container 1. This adaptor or adaptor member 20 is mounted upon a neck 9' of the valve housing 9 and which is provided with undercut portions, and by means of the claw members 21 engages behind a substantially ring-shaped undercut portion of the cover member 6 of the inner container 5. Lateral openings or holes 22 connect the valve 7 with the internal space of the outer container 1.

For the kinematic coupling of the dispensing or egress tubes 10 and 8 of the two valves 2 and 7 there is provided a plunger 24 equipped with a stepped shoulder 23. This shoulder 23, when the outer valve 2 is actuated and therefore when the plunger or plunger member 24 is downwardly displaced, engages behind a shoulder 25 provided in the adaptor 20 because of the lateral deflection forces which are always present in practice, so that the plunger 24, upon release of the outer valve 2, no longer can move back upwardly, and thus, retains the inner valve 7 open.

Figure 5:
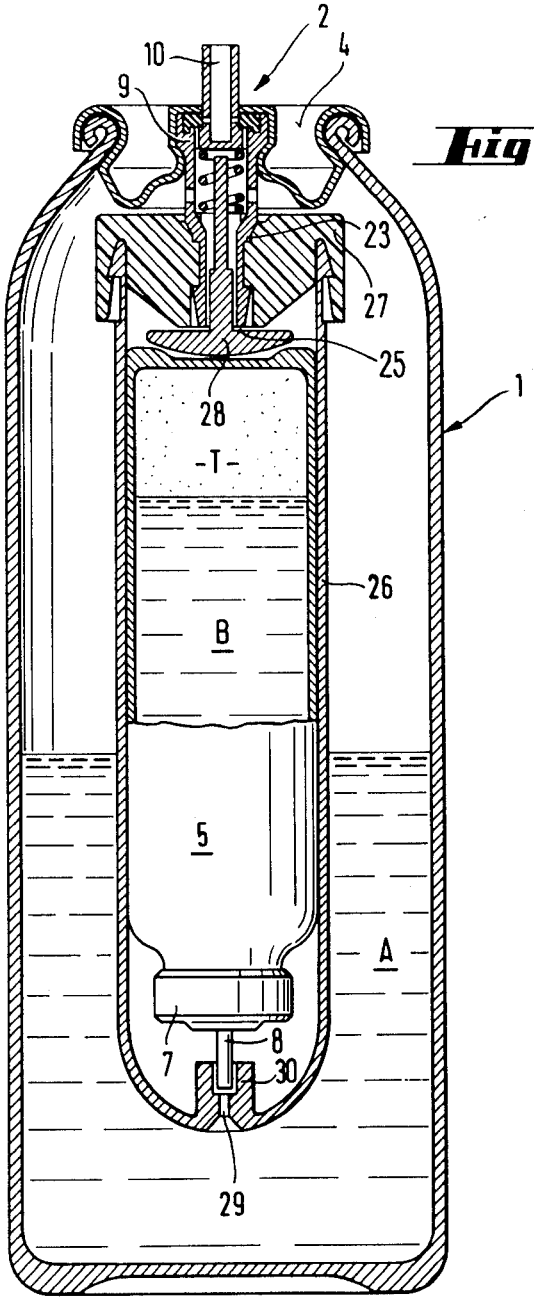

With the embodiment of FIG. 5 the inner container 5 is surrounded by a corrosion protection sleeve member 26 which is secured by means of an adaptor or adaptor member 27 at the housing 9 of the dispensing valve 2 of the outer container 1. A plunger member 28 couples the dispensing tube 10 of the outer valve 2 with the floor or bottom of the inner container 5 which is displaceable within the sleeve member or sleeve 26. The dispensing tube 8 of its valve 7 is supported in a fitting or mounting 30 of the corrosion protection sleeve or sleeve member 26 and which is provided with a throughflow opening 29. The attachment of the adaptor member 27 at the valve housing 9 and the arresting of the plunger or plunger member 28 in its inwardly depressed position are the same as for the embodiment of FIG. 4.

Figure 6:
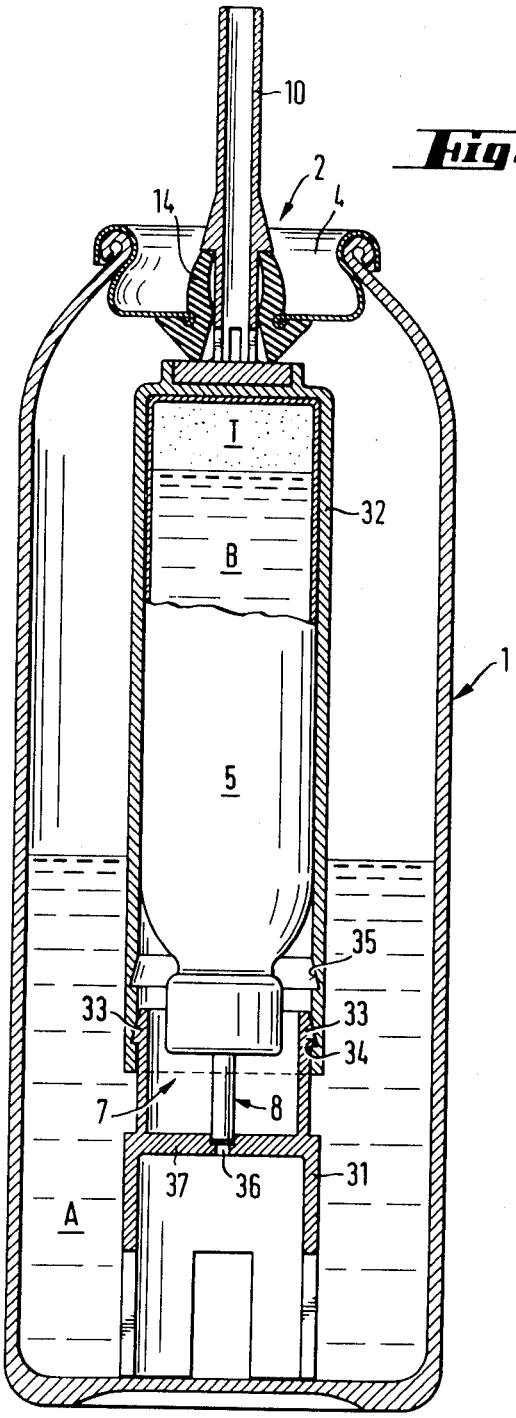

FIG. 6 illustrates an exemplary embodiment wherein the dispensing valve 2 of the outer container 1 is again constructed as a high-output type of valve. The inner container 5 is arranged with its valve 7 facing downwardly in a cup member or sleeve 32 which closed at its bottom by means of a support pedestal or socket 31. The pedestal or socket 31 is provided with resilient latching cams or dogs 33 which initially latch into the lower of two circumferential grooves 34 and 35 provided at the cup member or sleeve 32. The dispensing tube 8 of the inner valve 7 bears upon an intermediate wall 37 of the pedestal or socket 31 and which wall is equipped with an opening 36. The pedestal 31 itself extends downwardly almost up to the region of the floor of the outer container 1 or directly reposes thereat.

If the dispensing tube 10 of the outer dispensing valve 2 is depressed, then the cup member or sleeve 32 in conjunction with the inner container 5 move downwards. The support pedestal or socket 31 which then bears upon the floor of the outer container 1 is thus pressed inwardly into the cup member or sleeve 32 and opens the valve 7 of the inner container 5. At the same time the cams or dogs 33 latch into the upper circumferential groove 35 provided at the inner wall of the cup member or sleeve 32 and thus retain the valve 7 open.

As concerns the basic arrangement possibilities for the propellant gas and the pressure conditions there are applicable for the embodiments of FIGS. 3 to 6 the same considerations as for the embodiment with reference to FIGS. 1 and 2.

Figure 7:
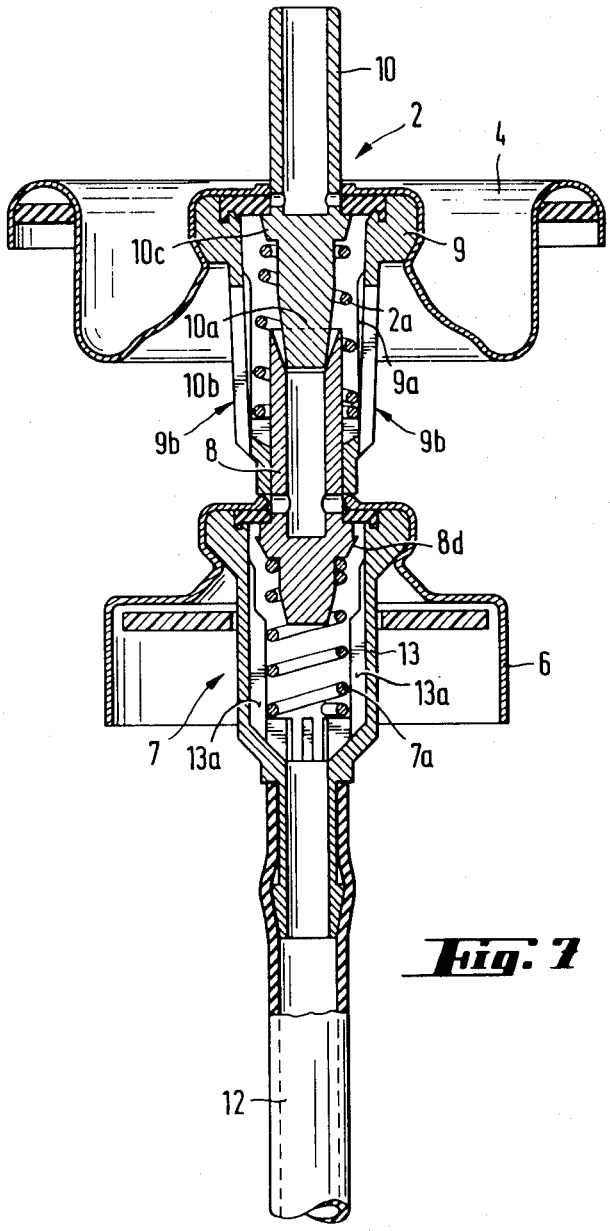
FIGS. 7, 8 and 9 each depict in respective axial sectional view through both of the dispensing valves a further exemplary embodiment of two-compartment package or pack constructed according to the invention, in three phases, before, during and after valve opening.
Figure 8:
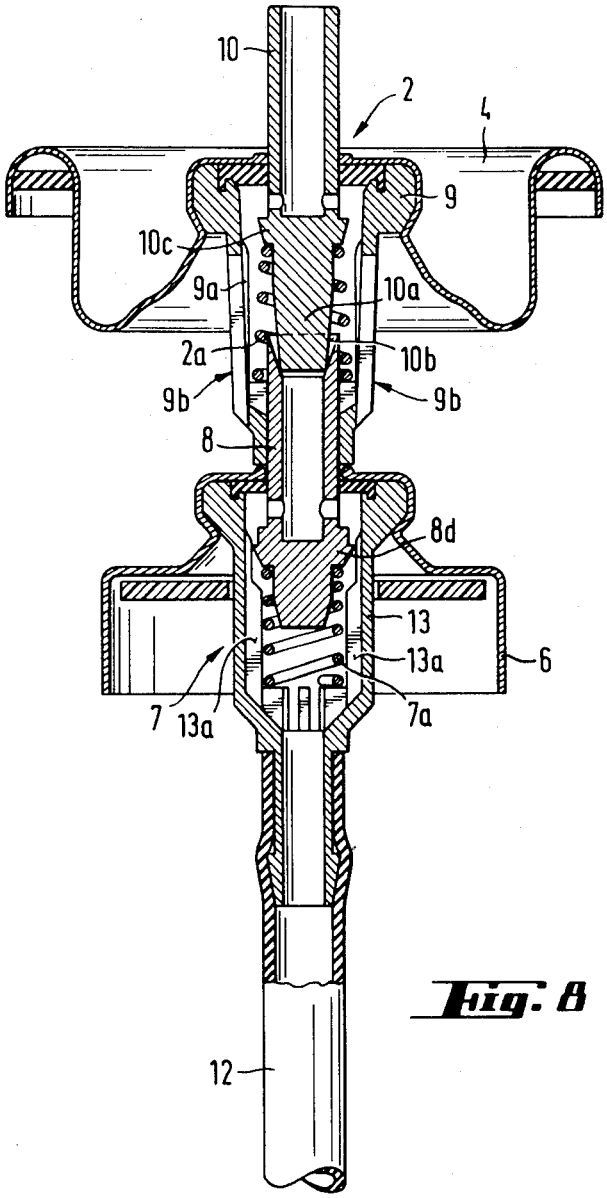
Figure 9:
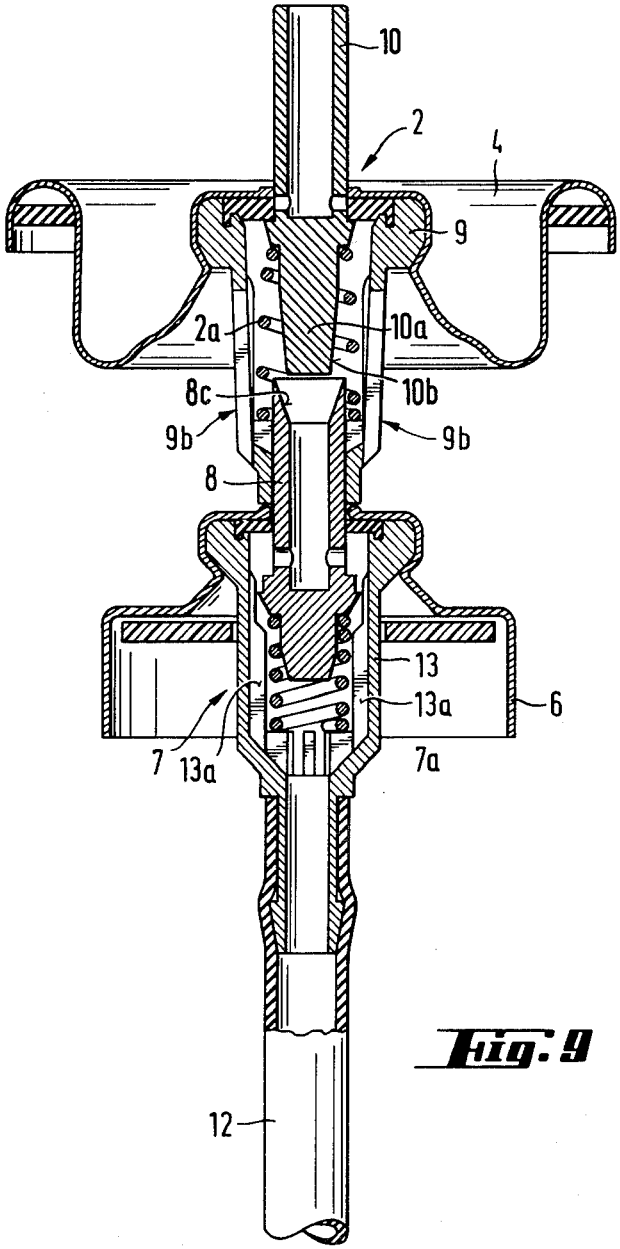

FIGS. 7, 8 and 9 illustrate a particularly advantageous construction of both of the dispensing valves 2 and 7, rendering possible a particularly simple and favorable constructional interconnection thereof. Also in FIGS. 7, 8 and 9 there have again been conveniently generally used the same reference characters to denote the same or analogous components as were used during the description of the prior embodiments heretofore discussed in this specification.

The general arrangement and construction of the package essentially corresponds to the package described above with respect to FIGS. 1 and 2, i.e. the inner container 5 bears directly or by means of an appropriate pedestal or the like upon the floor of the outer container 1, so that the inner dispensing valve 7 extends in the illustrated manner directly up to the outer dispensing valve or valve member 2. Both of the valves or valve members 2 and 7 are essentially of the same construction and, just as is the case for many standard aerosol valves, are retained by a respective helical spring **2*a* and 7*a* resiliently in their closed positions. The dispensing tube 8 of the inner valve 7, just as was the case for the embodiment of FIGS. 1 and 2, protrudes into the housing 9 of the outer valve or valve member 2. This dispensing tube 8 possesses at its upper end a conical seat 8*c*, as best seen by referring to FIG. 9, which coacts with a complementary cone member 10*b* provided at an inner extension or prolongation 10*a* of the dispensing tube 10 of the outer valve member 2** and forms therewith an intermediate valve.

Within the valve housings 9 and 13 the dispensing tubes 10 and 8, respectively, of both dispensing valves 2 and 7 are equipped with a shoulder **10*c* and 8*d*, respectively, at which bears, on the one hand, the helical springs 2*a* and 7*a*, respectively, and, on the other hand, delimits the outward movement of the dispensing tubes 10 and 8 or equivalent structure. At the inner circumference of the valve housings 9 and 13 there are formed a number of axially parallel, somewhat flexible or deformable rib members 9*a* and 13*a*, respectively. The rib members 9*a* of the outer valve 2 do not have any particular function. On the other hand, the rib members 13*a* of the inner valve 7 coact with the sawtooth-like profiled shoulder 8*d* of the dispensing tube 8 of the inner valve 2 in a manner such that the shoulder cuts into the same when the dispensing tube 8 is inwardly pressed, and thus, retains the dispensing tube 8 in its depressed position, so that it no longer can be upwardly pressed by the spring 7*a*, and thus, the inner valve 7 remains open (FIGS. 8 and 9**).

Before using the package all of the movable parts are located in the position shown in FIG. 7. In order to admix both of the packaged or filled components, as was heretofore the case, there is again inwardly pressed the dispensing tube 10 of the outer valve or valve member 2, and thus, there is also simultaneously opened the inner valve or valve member 7. Since the outer container is without pressure, the package or filled component contained therein does not escape notwithstanding the fact that the valve is open.

As long as the dispensing tube 10 of the outer valve member 2 is inwardly pressed or depressed, the cone member 10*b* of its dispensing tube 10 is located in sealing contact with the conical seat 8*c* of the dispensing tube 8 of the inner valve 7, so that also the package or filled component located within the inner container can not efflux therefrom (FIG. 8). However, as soon as the dispensing tube 10 of the outer valve 2 is released then the cone member 10*b* raises off of the seat 8*c* and the inner container which is pressurized is suddenly emptied by means of the openings 9*b* of the outer valve housing 9 into the outer container. The outer valve member 2, at this point in time, is already again closed, so that also during this phase of operation no filled or packaged material can escape through the outer valve member 2 (FIG. 9). Now by again actuating the outer valve member 2 in the usual fashion it is possible to remove the mixture composed of both of the now admixed packaged or filled components.

The construction of the valve members according to the embodiments of FIGS. 7 to 9 is constructionally particularly advantageous and also avoids any faulty manipulation of the package which could lead to undesired escape of the packaged or filled materials or, as the case may be, renders such faulty manipulations without any undesirable effect.

In the preceding specification the invention has been explained based upon a number of exemplary embodiments. However, it should be specifically understood that within the teachings and framework of the present invention numerous further variations are possible and the invention is in no way to be limited strictly to the exemplary illustrated embodiments disclosed herein, but is intended to embrace modifications and equivalents thereof as will readily suggest themselves to those skilled in the art.

While there are shown and described present preferred embodiments of the invention, it is to be distinctly understood that the invention is not limited thereto, but may be otherwise variously embodied and practiced within the scope of the following claims. Accordingly,

What I claim is:

1. A two-compartment package comprising:

an essentially dimensionally stable outer container for a first package component;

a dispensing valve provided for said outer container;

an inner container for a second package component;

said inner container being arranged within said outer container;

externally actuatable means for emptying the contents of the inner container into the outer container and for conjointly dispensing both of the admixed packaged components;

said inner container being constructed as an independent aerosol container equipped with a dispensing valve;

said inner container passessing a higher internal pressure than the internal pressure of the outer container;

said dispensing valve of said inner container flow communicating with an internal space of the outer container;

said dispensing valve of said inner container being kinematically coupled with the dispensing valve of the outer container in such a manner that during actuation of the dispensing valve of the outer container there is opened the dispensing valve of the inner container;

means for fixedly retaining in its open position the dispensing valve of the inner container;

said inner container is stationarily arranged with respect to the outer container;

each of said dispensing valves being provided with a dispensing tube;

the dispensing tubes of both of the dispensing valves being operatively coupled for thrust;

said dispensing valve of the inner container possesses a dispensing tube;

said means for retaining the dispensing valve of the inner container in the open position comprises longitudinal rib members formed at a housing of said dispensing valve of said inner container and a circumferential shoulder provided at the dispensing tube of the dispensing valve of the inner container; and said shoulder having a relatively sharp-edged profile and engaging, with the dispensing valve of the inner container open, into the longitudinal rib members while deforming the same.

2. A two-compartment package comprising:

an essentially dimensionally stable outer container for a first package component;

a dispensing valve provided for said outer container;

an inner container for a second package component;

said inner container being arranged within said outer container;

externally actuatable means for emptying the contents of the inner container into the outer container and for conjointly dispensing both of the admixed packaged components;

said inner container being constructed as an independent aerosol container equipped with a dispensing valve;

said inner container possessing a higher internal pressure than the internal pressure of the outer container;

said dispensing valve of said inner container flow communicating with an internal space of the outer container;

said dispensing valve of said inner container being kinematically coupled with the dispensing valve of the outer container in such a manner that during actuation of the dispensing valve of the outer container there is opened the dispensing valve of the inner container;

means for fixedly retaining in its open position the dispensing valve of the inner container;

said inner container is stationarily arranged with respect to the outer container;

each of said dispensing valves being provided with a dispensing tube;

the dispensing tubes of both of the dispensing valves being operatively coupled for thrust;

the dispensing valve of the inner container possessing a dispensing tube having an opening; and said opening of said dispensing tube of said dispensing valve of said inner container being structured as a valve seat for an end of an extension of a dispensing tube of the dispensing valve for the outer container and being sealingly closed by said end during the initial opening of said dispensing valves.

3. A two-compartment package, comprising:

an outer aerosol can including an essentially dimensionally stable outer container with a cover member tightly fitted thereto and a dispensing valve fitted in said cover member;

said dispensing valve being an aerosol valve which comprises a valve housing and an actuating and dispensing tube which, for the purpose of opening the dispensing valve, can be displaced axially inwardly of the valve housing against a restoring force of an elastic element thereby opening an otherwise closed passage between the interior and the exterior of the outer container;

said outer container containing a first package component to be dispensed;

an inner aerosol can mounted within said outer aerosol can and including an essentially dimensionally stable inner container with a cover member tightly fitted thereto and a dispensing valve fitted in said cover member;

said dispensing valve of said inner container discharging into the interior of said outer container and comprising an aerosol valve including an actuating and dispensing tube;

said inner container containing a second package component to be dispensed and a propellant, whereby the internal pressure of the inner container is higher than the internal pressure of the outer container;

means kinematically coupling the actuating and dispensing tube of the dispensing valve of the outer container with the dispensing valve of the inner container in such a manner that upon opening of the dispensing valve of the outer container there is opened the dispensing valve of the inner container; and means for fixedly retaining in its open position the dispensing valve of the inner container even when the dispensing valve of the outer container is closed again, thereby allowing the contents of the inner container to essentially entirely empty into the outer container and mix with the contents of the outer container.

4. The two-compartment package as defined in claim 3, wherein:

said outer container is essentially without pressure.

5. The two-compartment package as defined in claim 3, wherein:

said inner container is stationarily arranged with respect to said outer container; and said actuating and dispensing tubes of both of said dispensing valves are operatively coupled for thrust.

6. The two-compartment package as defined in claim 5, wherein:

the inner container is attached to the housing of the dispensing valve of the outer container.

7. The two-compartment package as defined in claim 5, wherein:

said means for fixedly retaining the dispensing valve of the inner container in the open position comprises longitudinal rib members formed at a housing of said dispensing valve of said inner container and a circumferential shoulder provided at the dispensing tube of the dispensing valve of the inner container; and said shoulder having a relatively sharp-edged profile and engaging, with the dispensing valve of the inner container open, into the longitudinal rib members while deforming the same.

8. The two-compartment package as defined in claim 5, wherein:

the actuating and dispensing tube of the inner container having an opening; and said opening of said actuating and dispensing tube of said dispensing valve of said inner container being structured as a valve seat for an end of an extension of said actuating and dispensing tube of the dispensing valve for the outer container and being sealingly closed by said end during initial opening of said dispensing valves.

9. The two-compartment package as defined in claim 3, wherein:

said means for fixedly retaining in its open position the dispensing valve of the inner container comprises self-latching stepped shoulder means.

10. The two-compartment package as defined in claim 3, wherein:

said means kinematically coupling the actuating and dispensing tube of the dispensing valve of the outer container with the dispensing valve of the inner container possesses a defined play.

11. The two-compartment package as defined in claim 3, further including:

a corrosion protection sleeve member within which there is arranged said inner container.

12. The two-compartment package as described in claim 3, wherein:

said inner container is displaceably mounted in inverted position within said outer container;

the actuating and dispensing tube of the dispensing valve of the inner container being stationarily arranged with respect to the outer container; and said inner container being operatively connected for thrust with the actuating and dispensing tube of the dispensing valve of the outer container.

13. The two-compartment package as described in claim 12, further including:

a sleeve member which is stationarily arranged with respect to the outer container; and said sleeve member clampingly encircling said inner container and being dimensioned such that the inner container, after its displacement caused by actuation of the dispensing valve of the outer container, does not return into its starting position owing to frictional forces prevailing between the inner container and the sleeve member.

14. The two-compartment package as defined in claim 13, wherein:

the outer container has a marginal open edge; and said sleeve member being attached at said marginal open edge of the outer container.

15. The two-compartment package as defined in claim 13, wherein:

said sleeve member has a floor portion equipped with at least one throughflow opening; and said dispensing tube of said dispensing valve of the inner container bearing at the floor portion of said sleeve member.

16. The two-compartment package as described in claim 3, wherein:

said kinematically coupling means comprises a plunger member connecting said actuating and dispensing tube of the dispensing valve of the outer container for thrust with a floor portion of the inner container.

17. The two-compartment package as described in claim 3, wherein:

said kinematically coupling means comprises a plunger member connecting said actuating and dispensing tube of the dispensing valve of the outer container for thrust with the actuating and dispensing tube of the dispensing valve of the inner container.

* * * * *

UNITED STATES PATENT AND TRADEMARK OFFICE

CERTIFICATE OF CORRECTION

PATENT NO. : 4,469,252

DATED : September 4, 1984

INVENTOR(S) : GERHARD OBRIST

It is certified that error appears in the above—identified patent and that said Letters Patent is hereby corrected as shown below:

Column 9, line 59, (Claim 1, line 15), delete "passessing" and replace by --possessing--

Signed and Sealed this

*Twelfth* Day of *February 1985*

[SEAL]

*Attest:*

DONALD J. QUIGG

*Attesting Officer* *Acting Commissioner of Patents and Trademarks*